US005184824A

United States Patent [19]

Riedinger

[11] Patent Number: 5,184,824

[45] Date of Patent: Feb. 9, 1993

[54] GOLF FACILITY AND METHOD

[76] Inventor: Thomas R. Riedinger, 7860 Island Crest Way, Mercer Island, Wash. 98040

[21] Appl. No.: 723,469

[22] Filed: Jun. 28, 1991

Related U.S. Application Data

[63] Continuation-in-part of Ser. No. 547,822, Jul. 3, 1990, abandoned.

[51] Int. Cl.[5] ..... A63B 69/36; A63B 67/02

[52] U.S. Cl. ..... 273/176 A; 273/182 R; 273/179 R

[58] Field of Search ..... 273/176 A, 176 R, 176 K, 273/176 L, 185 B, 182 RA, 32 H, 179 R

[56] References Cited

U.S. PATENT DOCUMENTS

| | | | |
|---|---|---|---|
| 1,851,423 | 3/1932 | Ely | 273/176 A |
| 2,003,074 | 5/1935 | Gage | 273/176 J |
| 2,455,806 | 12/1948 | Reach | 273/176 A |
| 2,482,210 | 9/1949 | Reach, Sr. et al. | 273/176 A |
| 3,083,021 | 3/1963 | Reilly | 273/176 AB |
| 3,129,943 | 4/1964 | McKee | 273/176 A |
| 3,310,310 | 3/1967 | McKee | 273/176 A |
| 3,464,703 | 9/1969 | Vallas | 273/176 A |
| 3,488,057 | 1/1970 | Fussell, Jr. et al. | 273/176 F |
| 3,599,980 | 8/1971 | Harmond | 273/176 A |
| 3,649,027 | 3/1972 | Vallas | 273/176 A |
| 3,685,832 | 8/1972 | Johnson | 273/176 A |
| 3,695,619 | 10/1972 | Brobston | 273/176 A |
| 3,708,173 | 1/1973 | Hewson, Jr. | 273/176 A |
| 3,719,361 | 3/1973 | Rotolo | 273/176 AB |
| 3,892,413 | 7/1975 | Rotolo | 273/176 AB |
| 3,904,209 | 9/1975 | Thomas | 273/176 A |
| 3,917,279 | 11/1975 | Barber | 273/176 A |
| 3,999,764 | 12/1976 | Nitsche | 273/176 A |
| 4,063,738 | 12/1977 | Michalson | 273/176 A |
| 4,129,300 | 12/1978 | Magnuson | 273/176 A |
| 4,505,478 | 3/1985 | Riethmiller | 273/32 H |
| 4,572,512 | 2/1986 | Tegart | 273/176 A |
| 4,655,451 | 4/1987 | Townsley | 273/32 H |
| 4,783,071 | 11/1988 | Tattershall | 273/32 H |
| 4,798,385 | 1/1989 | Tegart | 273/176 A |
| 4,846,478 | 7/1989 | Saint-Cricq | 273/182 R |
| 4,898,388 | 2/1990 | Beard, III et al. | 273/181 R |
| 4,928,973 | 5/1990 | Perry et al. | 273/176 A |
| 4,941,664 | 7/1990 | Pate | 273/35 B |
| 4,975,770 | 12/1990 | Troxell | 273/176 F |

FOREIGN PATENT DOCUMENTS

| | | | |
|---|---|---|---|
| 0221885 | 5/1987 | European Pat. Off. | 273/176 R |
| 0308833 | 3/1989 | European Pat. Off. | 273/176 R |

*Primary Examiner*—V. Millin
*Assistant Examiner*—Steven B. Wong
*Attorney, Agent, or Firm*—Joan H. Pauly

[57] ABSTRACT

A course includes a plurality of greens and teeing locations with varying terrain to provide iron shots of varying length and difficulty onto the greens. In three embodiments, the greens are located in a central green area, and the teeing locations are in a peripheral area around the central green area. In a fourth embodiment, the greens are in the peripheral area, and the teeing locations are in the center portion of the course and between the greens. Television cameras are positioned to receive images of the greens. Monitors at the teeing locations have grids overlaying the images to enable accurate determination of the distance of the ball from the green's flag stick. A green clearing device has a sweeping mechanism rotatably mounted on the flag stick to sweep balls off the green into the center cup or a peripheral outer ball collector. The clearing device may be remotely activated at the TV monitor.

18 Claims, 8 Drawing Sheets

GOLF FACILITY AND METHOD

RELATED APPLICATION

This application is a continuation-in-part of application Ser. No. 07/547,822, filed Jul. 3, 1990 now abandoned.

DESCRIPTION

1. Technical Field

This invention relates to golf-like games and to courses for playing golf-like games and practicing golf skills and, more particularly, to a game and a course which provide varied iron shots and putting in a short amount of time, a method of scoring, and an automatic device for clearing a green of golf balls.

2. Background Information

Golfing has become increasingly popular in the last few years. The increased popularity has placed more demand on available golf courses and has created a need for facilities at which people can play, in a relatively short amount of time, competitive games that require a broad range of golf skills. Driving ranges for practicing long shots have been known for a number of years. However, neither driving ranges nor other types of known facilities provide meaningful competition in a short total playing time.

3. Disclosure of the Invention

A subject of the invention is a course for playing a golf-like game and practicing iron shots According to an aspect of the invention, the course comprises a central green area, a peripheral area around the central green area, a plurality of separate, spaced apart teeing locations in the peripheral area, and screening. The central green area includes a plurality of separate greens. Each teeing location is positioned to provide iron shots with predetermined trajectories onto at least one of the greens corresponding to the teeing location The central green area and peripheral area have varying terrain, and the teeing locations are positioned, to provide iron shots of varying length and difficulty onto the greens. The greens and the teeing locations are arranged to provide space between the teeing locations and separate players at any one of the teeing locations from players at the other teeing locations, and the screening is positioned to inhibit shots from any one of the teeing locations crossing the trajectories corresponding to another teeing location, to minimize disturbance of players by errant shots.

According to another aspect of the invention, the course comprises a plurality of greens each having a hole for receiving golf balls hit onto the green, and a plurality of teeing locations. The greens and teeing locations have varying terrain as described above. The course also includes a plurality of television cameras, television monitors, and grids. Each camera is positioned to receive an image of a different one of the greens. The monitors are at the teeing locations and are connected to the cameras for receiving the images of the greens therefrom. A grid is superimposed over each image by the monitors and is configured to accurately display the distance from the hole of a golf ball hit onto the corresponding green and thereby enable scoring of an iron shot onto the green. The greens may be located in a central green area, as described above, or may be spaced apart in a peripheral area of the course The central green area configuration is generally preferred. However, in situations in which less than 30 acres is available for the greens and teeing locations and/or climate and other environmental conditions make the maintenance of the teeing locations very difficult without the use of artificial turf, the latter configuration with the greens around the periphery and the teeing locations in the center and/or between the greens is preferred. In either case the course preferably includes hazards associated with the greens in order to provide practice which closely simulates play on a full size golf course.

Other preferred features may be provided in connection with either configuration One such feature is a practice green area separate from the greens described above and having a plurality of holes for putting practice. Another feature is an arrangement of teeing locations to provide a choice of iron shots to different greens from at least one of the teeing locations. The latter feature makes it possible for users of the course to adjust the difficulty of the course to their individual skills by choosing the easier or more difficult hole at the teeing location.

In courses with the central green area configuration, if space permits, the course preferably further comprises a plurality of putting practice greens spaced around the central green area in the peripheral area. The practice greens correspond to the greens in the central green area. When television cameras in the central green area and monitors at the teeing locations are provided, there preferably are a plurality of television cameras connected to the monitors and positioned to receive images of the practice greens corresponding to the images of the greens in the central green area. This allows users to practice putting on the practice greens, with the putting positions determined by the iron shots onto the central green area, without actually entering the central green area. This, in turn, helps to preserve the central green area and allows more users to practice on the course at any one time.

Another subject of the invention is apparatus for clearing a green of golf balls. Such apparatus may be used, for example, to clear the greens in the central green area of the course of the invention without requiring entry onto the central green area. It is also useful in any other situation in which it is desirable to rapidly and automatically clear golf balls from a green.

The apparatus preferably includes a rigid flag stick that defines a vertical axis. A rod is mountable on the flag stick to extend radially outwardly from the stick to a peripheral area of the green, and to rotate about the axis. A plurality of sweeping members are carried by the rod. The members are mounted at spaced locations along the rod. Each member is free to move vertically relative to the rod to follow the terrain of the green. A support engages an outer end portion of the rod to guide and support the outer end portion around the peripheral area of the green. The apparatus preferably further comprises a guide track around the peripheral area. The support has a lower end that engages the track. When the periphery of the green is not circular and/or the flag stick is not at the center of the green, the support is preferably slidable along the rod to automatically adjust to varying distance between the track and the flag stick. When the clearing device is provided along with television monitors, the monitors preferably carry activators for activating the green clearing devices.

Still another subject of the invention is a method of playing a golf-like game. The game is played on a course having a plurality of greens, each with a flag stick, and a plurality of corresponding spaced teeing locations. The method comprises placing a first golf ball on one of the teeing locations, and hitting the first ball onto a corresponding green. A second golf ball is placed on the teeing location and is hit onto the same green. A score is determined by the distances of the first and second balls from the flag stick of the green. Without entering onto the green, the player moves to a second teeing location and repeats the steps of placing and hitting first and second golf balls and determining a score. Preferably, the scores are determined by viewing a television monitor having a grid to determine the distances. In one embodiment of the method, the course includes a second plurality of greens, and the game includes placing a third golf ball on one of the second plurality of greens after hitting the first and second balls. The third ball is placed in a position corresponding to the position of one of the first and second balls on the green onto which such balls were hit. The third ball is putted.

The course and method of the invention allow golf players to engage in meaningful competition and to obtain varied practice of golf skills in a relatively short period of time. For example, iron shots and putts for an equivalent of nine different holes may generally be played in less than an hour. When the course of the invention is associated with a driving range, all the basic golfing skills may be practiced in a short amount of time. Because the course and method of the invention require a relatively small land area, the course may be built at a reasonable expense and may be provided closer to population centers than full size golf courses which require greater amounts of land.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

Figure 1:
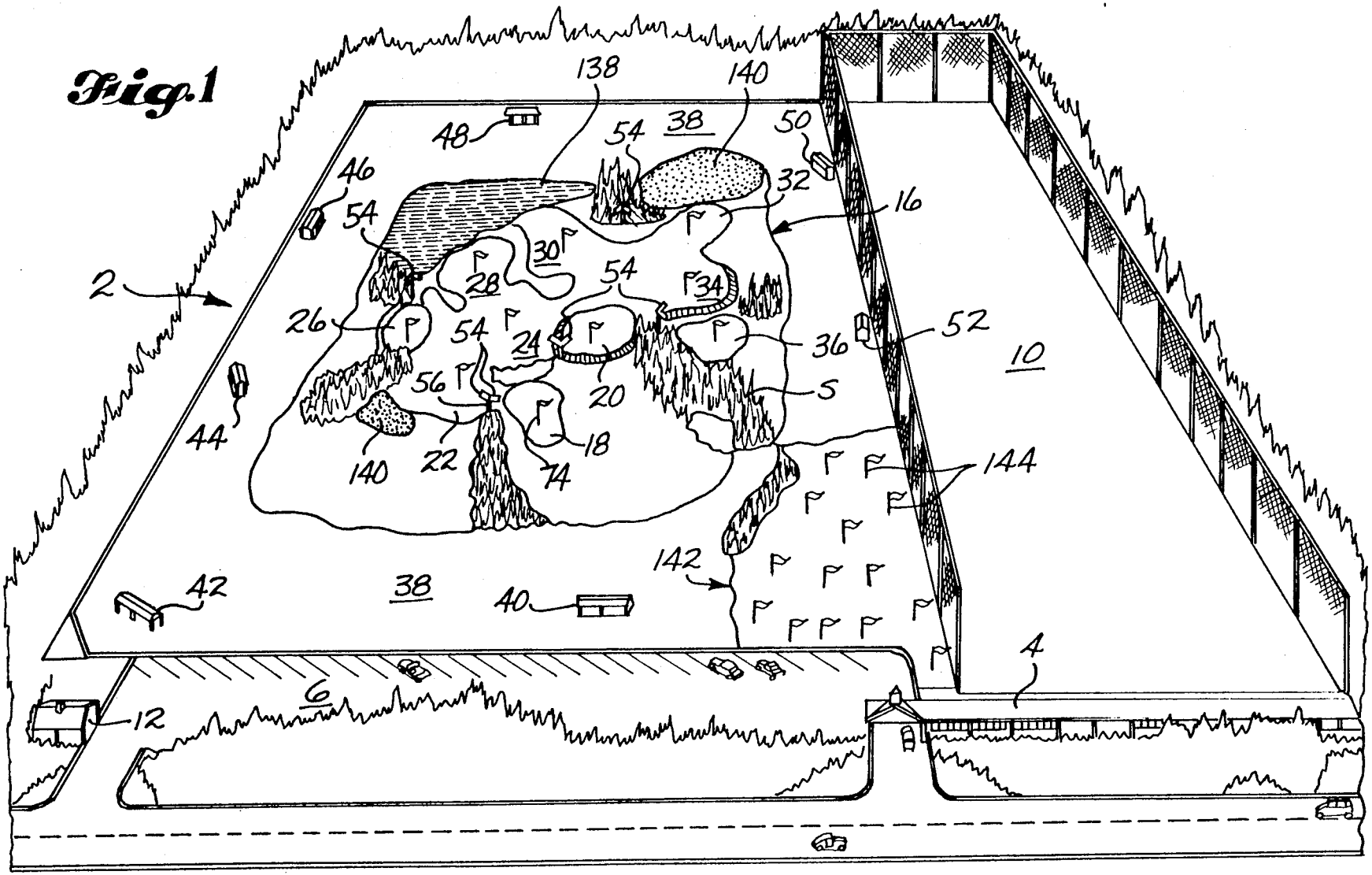
FIG. 1 is a pictorial view of a first preferred embodiment of the course of the invention and an associated driving range.
Figure 3:
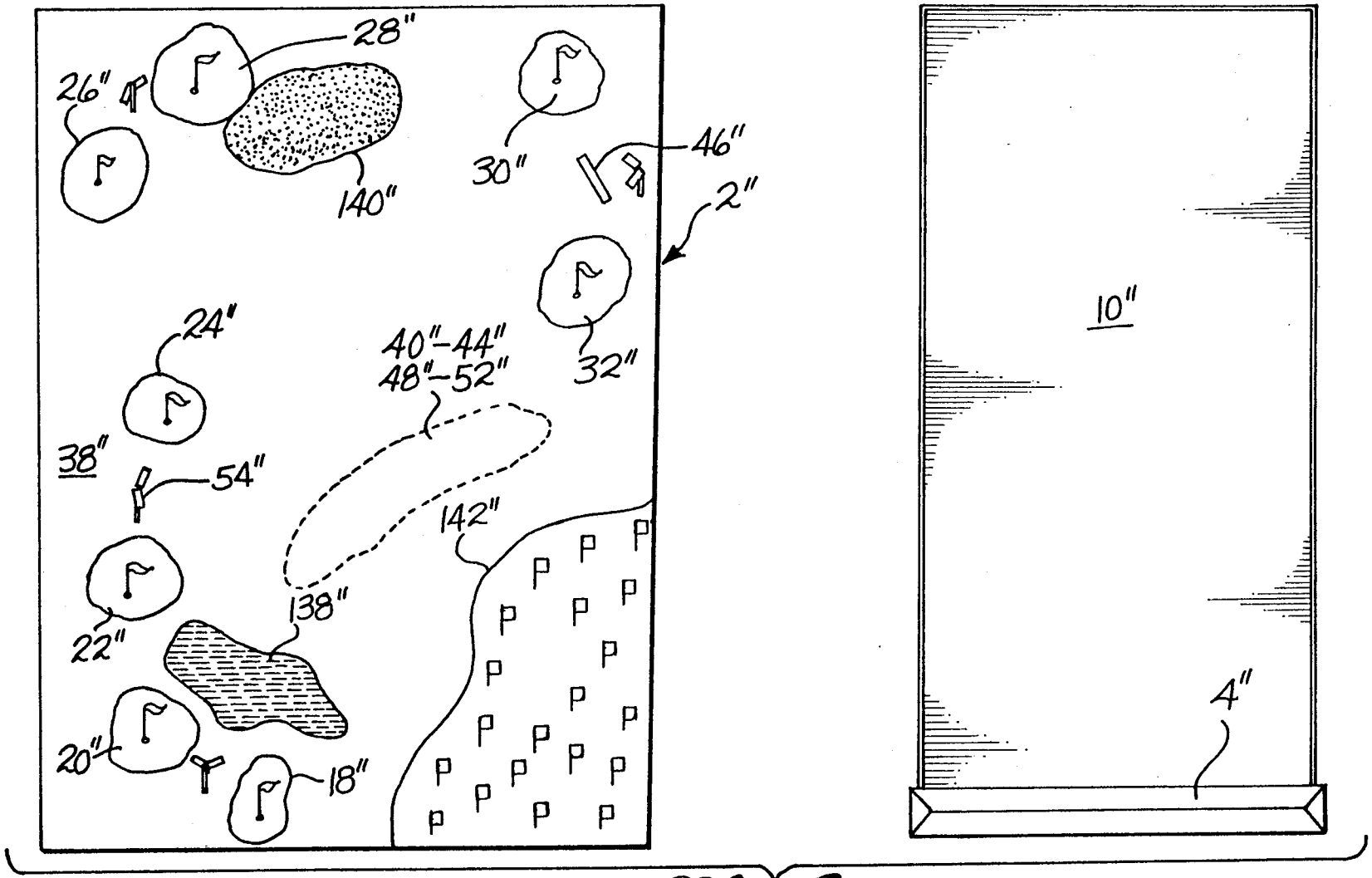
FIG. 3 is a plan view of a third preferred embodiment.
Figure 13:
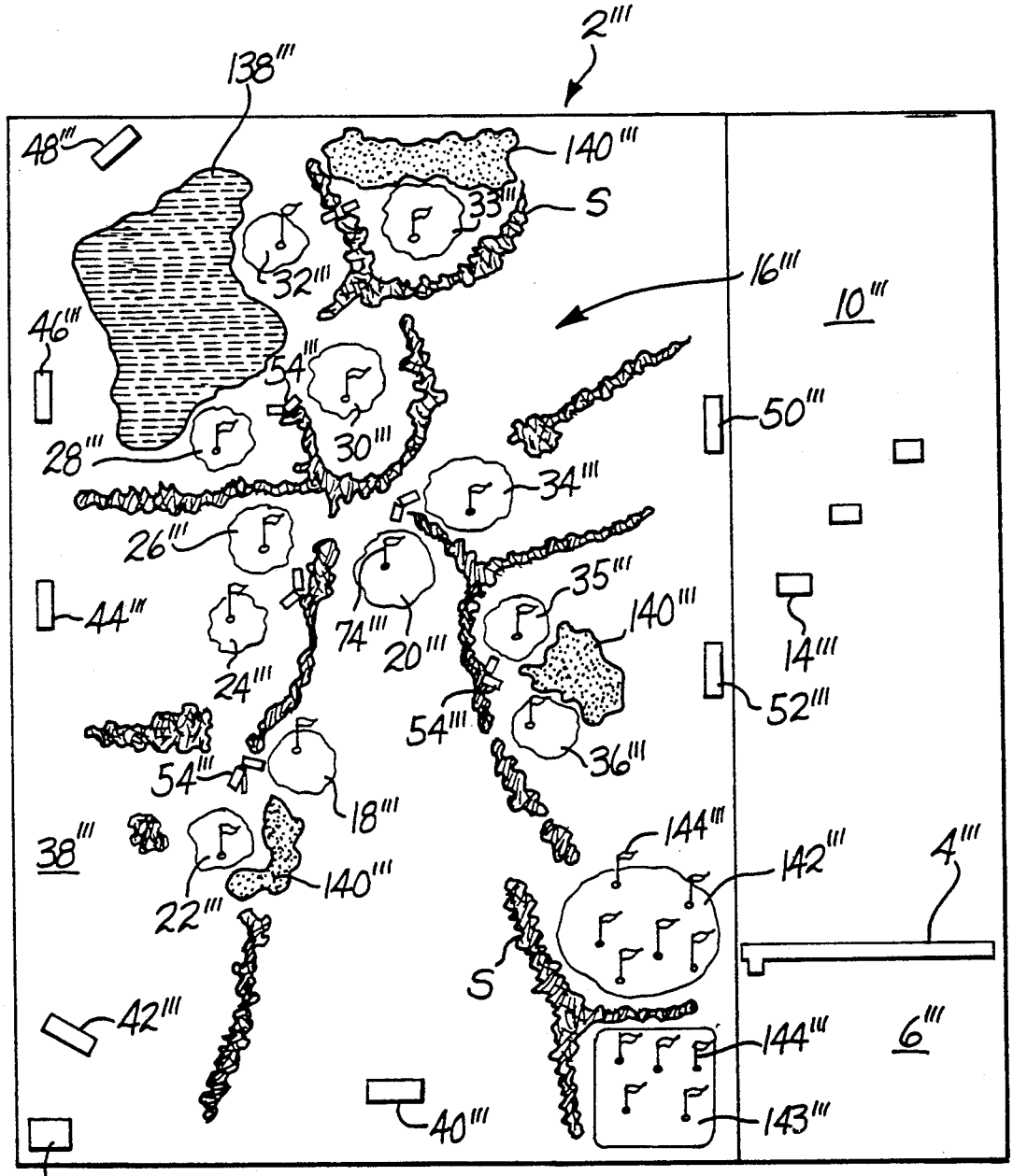
FIG. 13 is a plan view of a fourth preferred embodiment.

The drawings show four embodiments of a course 2, 2', 2'', 2''' and the preferred embodiment of a green clearing device 72 that are constructed according to the invention and that constitute the best modes for carrying out the invention currently known to the applicant. In FIGS. 1, 3, and 13, the courses 2, 2'', 2''' are shown as part of facilities that also include driving ranges 10, 10'', 10'''. It is anticipated that, in most applications, the course of the invention will be in a facility that also includes a driving range. However, the course may also be provided in a separate facility by itself or in facilities including other types of practice or play areas. As shown in the drawings, the course 2, 2', 2'', 2''' of the invention is designed for play that is generally equivalent to playing the critical approach shots of nine holes of regular golf. This level of play is preferred because it provides an interesting competitive game that can be completed in a relatively short amount of time and can be accommodated on a relatively small tract of land. However, the size of the course and the effective number of playing holes may be varied within the scope of the invention.

Figure 2:
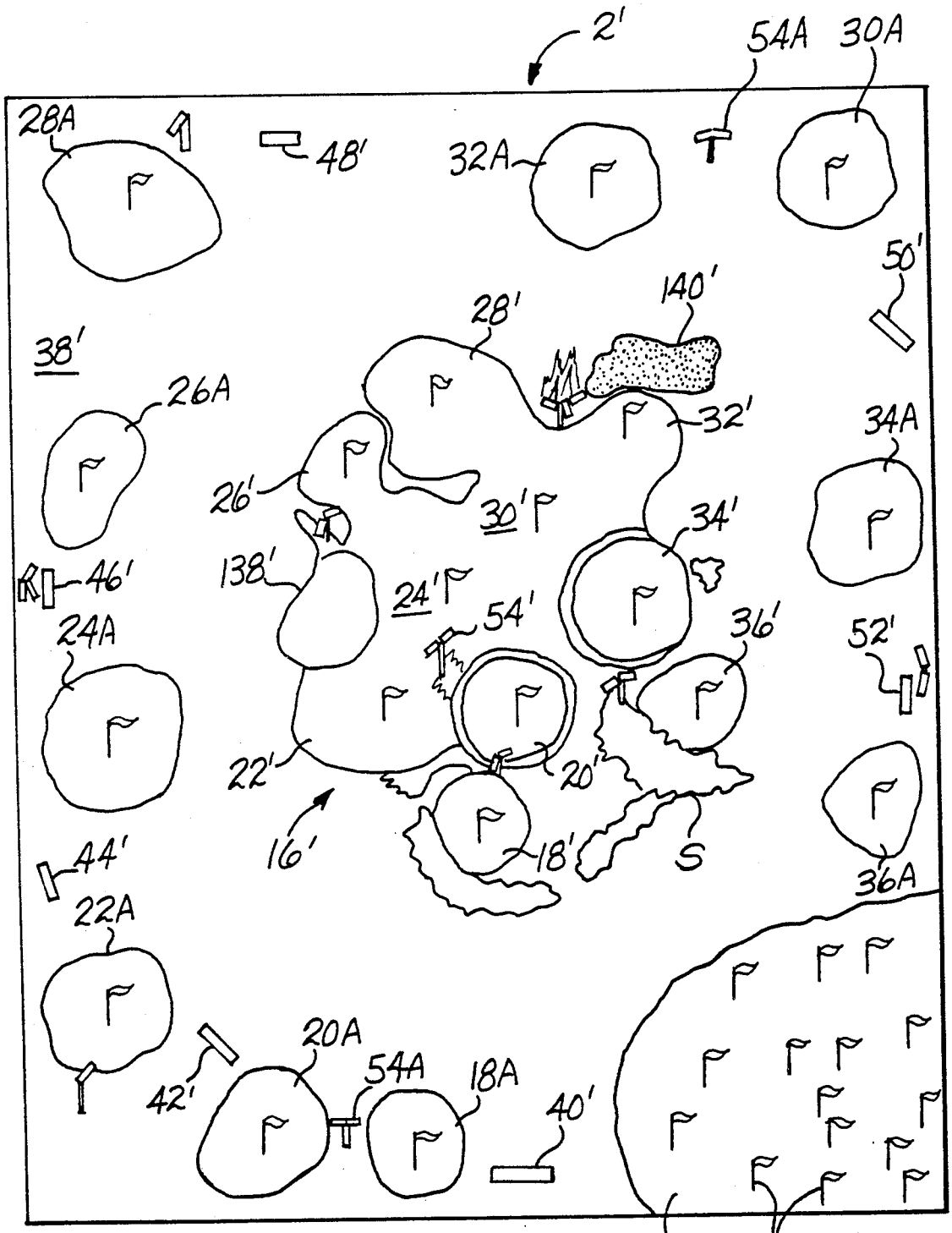
FIG. 2 is a plan view of a second preferred embodiment.

FIGS. 1, 2, 3, and 13 show four different embodiments of the course 2, 2', 2'', 2'''. In the four figures, like elements are designated by like reference numerals. In FIG. 2, a single prime symbol is added to the numeral of the corresponding element, in FIG. 3 a double prime symbol is added, and in FIG. 13 a triple prime symbol is added.

The course of the invention is intended for playing a golf-like game and practicing golf skills, such as iron shots. Each of the four preferred embodiments of the course shown in the drawings includes a plurality of greens and a plurality of teeing locations The greens and teeing locations have varying terrain, and are positioned, to provide iron shots of varying length and difficulty onto the greens.

In the embodiments shown in FIGS. 1, 2, and 13, respectively, the greens onto which iron shots, are made are in a central green area 16, 16', 16'''. The teeing locations 40–52, 40'–52', 40'''–52''' are in a peripheral area 38, 38', 38''' around the central green area 16, 16', 16'''. They are spaced apart around the peripheral area 38, 38', 38'''. Preferably, each of the teeing locations 40–52, 40'–52', 40'''–52''' includes a small shelter, as shown in FIG. 1. The peripheral area 38, 38', 38''' preferably extends substantially all the way around the central green area 16, 16', 16'''. However, it could extend only part of the way around to accommodate limited availability of space and/or special terrain conditions. Each of the teeing locations 40–52, 40'–52', 40'''–52''' is positioned to provide iron shots with predetermined trajectories onto at least one of the greens. The green or greens for which trajectories are predetermined correspond to the teeing location. There is screening S in the central green area and the peripheral area. The screening S is positioned to inhibit shots from any one teeing location crossing the trajectories corresponding to another teeing location.

Referring to FIG. 1, in the first preferred embodiment the central green area 16 includes ten separate greens 18-36 and 20 a water hazard 138. Although each green 18-36 is a separate green, adjacent greens may be contiguous in order to maximize use of available space For example, in FIG. 1 greens 22 and 24 are shown as being contiguous. FIG. 1 shows seven teeing locations 40-52, spaced around the central green area 16 in the peripheral area 38. The sand trap 140 adjacent to green 32 serves as an eighth teeing location.

A game could be played on the course 2 with iron shots being made onto all ten of the greens 18-36. In that case, iron shots onto two different greens 40-52, would be made from two of the teeing locations 40-52,. However, in order to move groups of players efficiently through the course 2, it is preferable that a game be played in which each player makes iron shots onto eight of the ten greens 18-36. For example, at teeing location 40 the players would have a choice between the relatively short shot onto green 18 or the longer shot onto green 20. Shots from teeing locations 42, 44 could be made onto greens 22, 26. Green 24 provides an alternative longer shot for either teeing location 42 or 44. A single choice of shots from teeing locations 46-52 would be onto greens 28, 30, 34, 36, respectively. The eighth shot would be onto green 32 from the adjacent sand trap 140.

Preferably, the players would not enter the central green area 16 after making their iron shots, but rather would proceed to the next teeing location as soon as all iron shots at a particular teeing location 40-42 were completed. Putting competition and practice is provided for at the practice green area 142 in the peripheral area 38 separate from the central green area 16. The practice green area 142 has a plurality of holes, designated by the flags 144 in FIG. 1, to allow each player to make a number of putting shots. Preferably, the area 142 has varying terrain to vary the putting shots. The combination of the iron shots onto the central green area 16 and the putting in area 142 provides practice substantially equivalent to nine holes of golf, excluding driving practice. The latter can be obtained separately on the adjacent driving range 10.

The facility shown in FIG. 1 may vary in size. However, it is designed for and preferably occupies 40 acres for the course 2 and an additional 8 to 9 acres for the driving range 10. The facility includes all the amenities necessary for the comfort of the players and the efficient maintenance of the facility. A pro shop 4 is located at the front of the driving range 10. A parking lot 6 is arranged at the front of the course 2. A maintenance building 12 is located in a front corner of the facility near the parking lot 6. This building could also be located at the far end of the driving range 10.

Referring to FIG. 2, the second preferred embodiment 2' also has a central green area 16' including ten separate greens 18'-36'. A separate practice green area 142' with a plurality of holes designated by the flags 144' is positioned in a corner of the peripheral area 38', as in FIG. 1. The major difference between the course 2' shown in FIG. 2 and the course 2 shown in FIG. 1 is that the course 2' includes a plurality of putting practice greens 18A-36A spaced around the central green area 16' in the peripheral area 38'. The practice greens 18A-36A are preferably contoured to have terrain substantially duplicating the terrain of the greens 18'-36, in the central green area 16'. This allows the game to include putting out of the shots onto the central greens 18'-36' without requiring the players to enter the central green area 16'. This, in turn, helps to preserve the central green area 16', and allows the players to complete the game more quickly. As in the first embodiment, in the embodiment of FIG. 2, a plurality of teeing locations 40'-52' are spaced around the central green area 16, in the peripheral area 38', and a sand trap 140' provides an eighth teeing location.

The course 2' is preferably provided in connection with a driving range (not shown). The addition of the practice greens 18A-36A provides additional putting opportunities but also requires more land than the course 2 shown in FIG. 1. The embodiment of FIG. 2 is preferred When more than 40 acres are available for the course.

FIG. 3 shows a third preferred embodiment 2" of the course of the invention. This embodiment is preferred when less than 40 acres is available for the course and/or the available property is divided. In the embodiment of FIG. 3, there is no central green area. Instead, the greens 18"-32" are spaced around the peripheral area 38" of the course 2". The teeing locations 40"-52" are located in the center portion of the course 2" and between the greens 18"-32". A sand trap 140" provides an eighth teeing location. A separate practice green area 142" is positioned in a corner portion of the course 2". The course 2" preferably includes hazards, such as the water hazard 138". As shown in FIG. 3, a driving range 10" and the pro shop 4" are located on a noncontiguous piece of property.

FIG. 13 shows a fourth preferred embodiment, which is basically a modification of the embodiment shown in FIG. 1. This embodiment includes twelve separate greens 18'''-36''' in a central green area 16''' surrounded by a peripheral area 38'''. A water hazard 138''' and three sand traps 140''' are located in the central green area 16''' and the adjacent peripheral area 38'''. The greens 18'''-36''' in the embodiment of FIG. 13 are not as close together as the greens 18-36 shown in FIG. 1. The greater spacing of the greens shown in FIG. 13 retains the advantage of efficient use of the space in the central green area 16''' while permitting greater screening by the use of trees and shrubs between the holes. The enhanced natural screening S increases the attractiveness of the course 2'''; helps minimize, if not eliminate, the chances of balls hit from one teeing location interfering with play from another teeing location; and enhances the similarity of the play on the course 2", to play on a full size golf course.

Like the embodiment of FIG. 1, the embodiment of FIG. 13 includes seven separate teeing locations 40'''-52''' spaced around the central green area 16''' in the peripheral area 38'''. An eighth teeing location is provided by the sand trap 140''' adjacent to green 33'''. The teeing locations 40'''-52''', 140''' are spaced apart substantially all the way around the peripheral area 38'''. The arrangement of teeing locations 40'''-52''', 140''' with space therebetween ensures that players at a given teeing location are separated from players at other teeing locations. It also, along with the screening S, helps ensure that none of the players is disturbed by errant, or simply nearby, shots. The result is a very close simulation of the playing conditions on a full size course. This high quality undisturbed play cannot be provided by conventional reduced size courses which lack the separation and screening features of the present invention.

Referring to FIG. 13, players may hit onto either green 18''' or green 20''' from teeing location 40''', onto green 22''' from teeing location 42''', onto either green 24''' or green 26''' from teeing location 44''', onto green 34''' from teeing location 50''', and onto either green 35''' or green 36''' from teeing location 52'''. Each of teeing locations 46''' and 48''' has a green 28''', 32''', respectively, corresponding thereto In addition, green 30''' provides a second choice for either of these teeing locations 46''', 48'''. As noted above, players hit onto green 33''' from the adjacent sand trap 140'''.

The course 2''' has a putting practice area 142''', similar to the practice green area 142 shown in FIG. 1, for players who have completed the round of the teeing locations 40'''-52'''. In addition, the embodiment of FIG. 13 has a second putting practice green area 143''''. This second practice area 143''' is preferably screened from the first area 142''', the central green area 16''', and the teeing locations 40'''-52'''. It is intended for use by players who want only putting practice, or only putting practice and practice on the driving range 10'''. Each of the two practice areas 142''', 143''' has a plurality of holes, designated by flags 144'''. The driving range 10''' has a plurality of targets 14'''. The course 2''' could also be provided with a set of putting practice greens spaced around the central green area 16''' in the peripheral area 38''', like the practice greens 18A-36A shown in FIG. 2.

In each of the four embodiments, there are preferably a plurality of television cameras 54, 54', 54'', 54''' each positioned to receive an image of a different one of the greens 18-36, 18'-36', 18''-32'', 18'''-36''' onto which iron shots are made The purpose of the cameras 54, 54', 54'', 54''' is to allow quick and accurate scoring of iron shots without requiring the scorer to enter upon the green and without marring the course or degrading its play characteristics by placing distance designations directly thereon. Referring to FIG. 1, the cameras 54 may be mounted on a plurality of posts 56 positioned relative to the landscaping to prevent interference with the play and limit the visibility of the cameras 54 and posts 56 and thereby maintain the attractiveness of the course 2. Preferably, where possible, more than one camera 54 is mounted on each post 56. In the course 2 shown in FIG. 1, there are two cameras 54 on each post 56.

Figure 4:
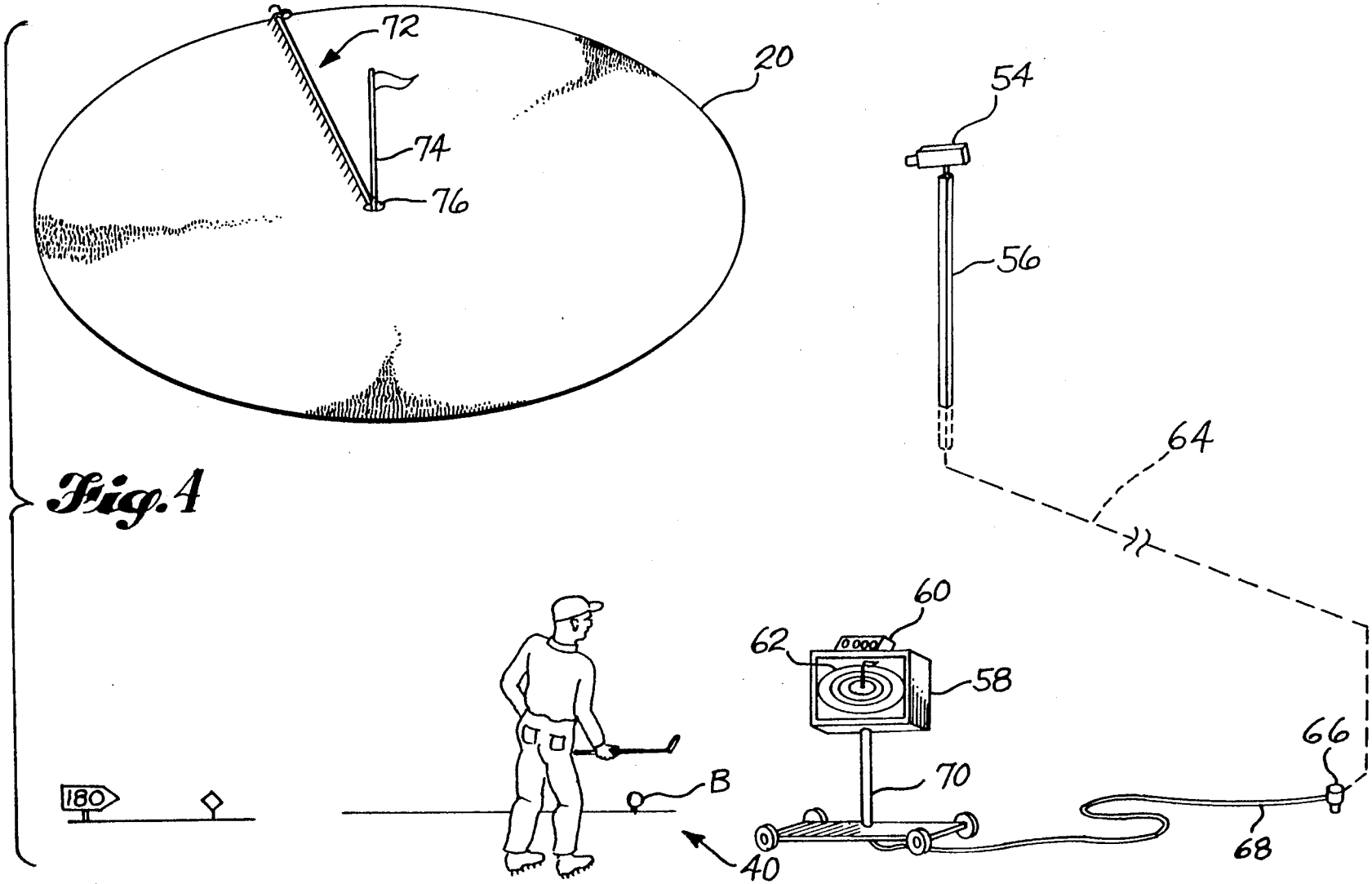
FIG. 4 is a pictorial view of selected elements of the first preferred embodiment.

One of the cameras 54 and associated post 56 shown in FIG. 1 is shown in more detail in FIG. 4. FIG. 4 is a partially schematic representation of portions of the course 2 that illustrate the television monitoring feature As shown in FIG. 4, the camera 54 is positioned on post 56 to obtain an image of one of the greens 20 A plurality of television monitors 58 are positioned at the teeing locations 40-52. FIG. 4 illustrates the monitor 58 at the teeing location 40. The monitor 58 is connected to the camera 54 by means of an underground cable 64 which extends from the post 56 to an above-ground plug-in receptacle 66. A cable 68 from the monitor 58 is plugged into the receptacle 66. The monitor 58 is mounted on a wheeled support 70 to allow it to be easily moved by the players to facilitate the playing and scoring of the game.

As shown in FIG. 4, the image of the green 20 on the monitor 58 has a grid 62 overlaying it. The grid 62 is superimposed over the image by the monitor 58 and is configured to accurately display the distance of a golf ball B hit onto the green 20 from the hole or cup 76 (or the flag stick 74) of the green 20. The hole 76 is, for the purposes of scoring, the usual type of hole on a golf green for receiving golf balls hit onto the green. The accurate display of the distance of the ball B from the hole 76 permits easy and accurate scoring of an iron shot onto the green 20. Preferably, each player uses balls of a different color to further facilitate scoring.

In the embodiment of FIG. 2, there are preferably additional TV cameras 54A to obtain an image each of the practice greens 18A-36A. The images of the practice greens 18A-36A correspond to the images of the greens 18'-36' in the central green area 16'. This makes it possible for players to precisely position their balls on the practice greens 18A-36A to correspond to the positions where their iron shots ended up on the central greens 18'-36'. For example, the image of the practice green 18A-36A could be chroma-keyed over the green of the image of the central green 18'-36' with the grid 62 superimposed. This would enable a player to precisely position his ball on the practice green 18A-36A simply by aligning it with the image of the ball on the center green 18'-36', i.e. by correcting its position until only one ball was visible on the monitor display.

In each embodiment, the trajectories of iron shots are planned to minimize the potential for errant shots disturbing other players. Appropriate screening is used when natural contours and foliage do not provide adequate separation. The screening preferably comprises trees and shrubs and, where necessary, discreet fencing.

Figure 5:
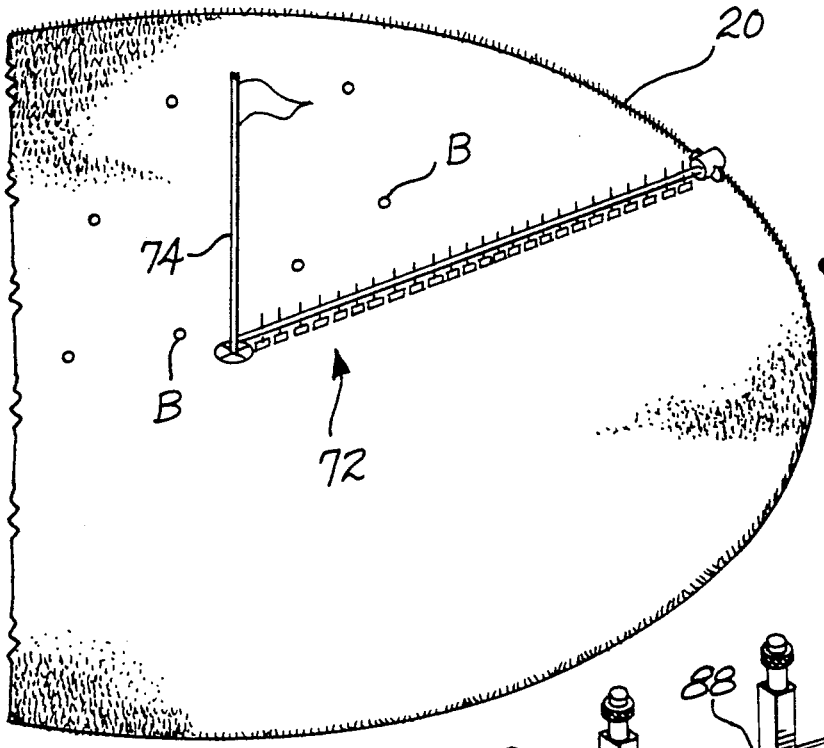
FIG. 5 is a partial pictorial view of the green shown in FIG. 4 illustrating the green clearing device.
Figure 6:
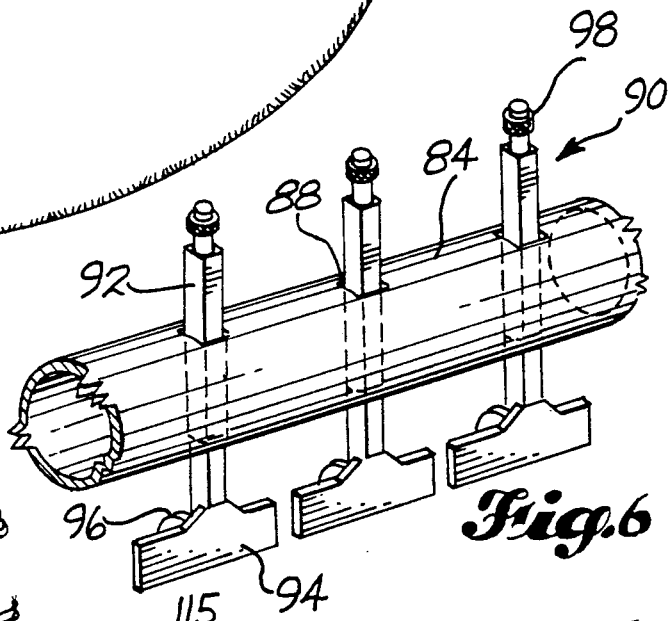
FIG. 6 is a pictorial view of a mid portion of the clearing device.
Figure 7:
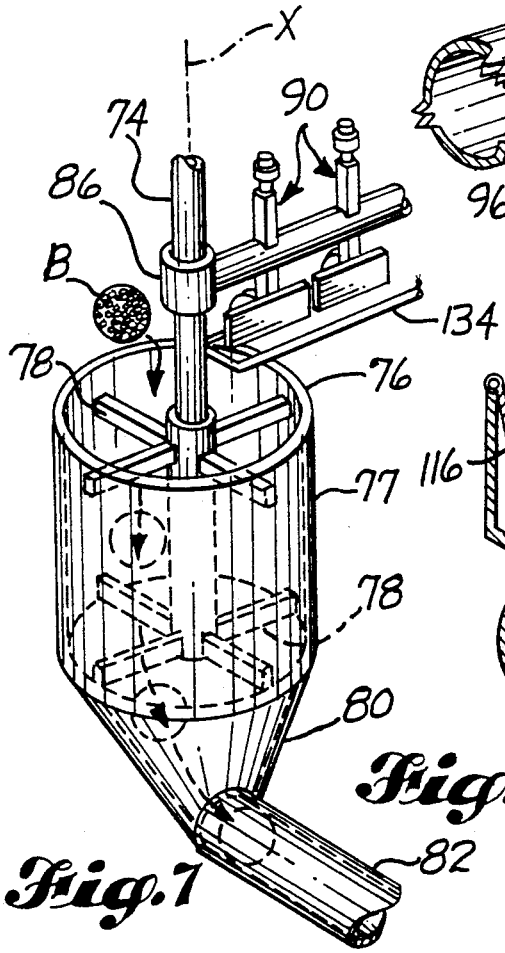
FIG. 7 is a pictorial view of the inner portion of the device.

FIGS. 4-12 illustrate the green clearing device and ball retrieval system of the invention. This system allows for the quick and efficient automatic clearing of the greens and retrieval of the balls so that they may be used by the next group of players. In the preferred embodiment, a green clearing device 72 is provided on each green onto which iron shots are made but putting is not carried out. The flag stick 74 associated with the hole or cup 76 is substantially rigid and is rigidly mounted to support a sweeping mechanism. The mounting of the flag stick 74 is illustrated in FIG. 7. The hole 76 is provided with a cylindrical sidewall 77 of a suitably strong material. The sidewall 77, except its upper rim, is underground, as illustrated in FIG. 5. Two spider supports 78 support the stick 74 in a central position relative to the sidewall 77. A funnel-shaped structure 80 is positioned at the bottom of the sidewall 77 and communicates the interior of the sidewall 77 with a conduit 82. A ball B entering the cup 76 may easily fall between the spokes of the spiders 78 down into the funnel 80 and then the conduit 82.

Figure 12:
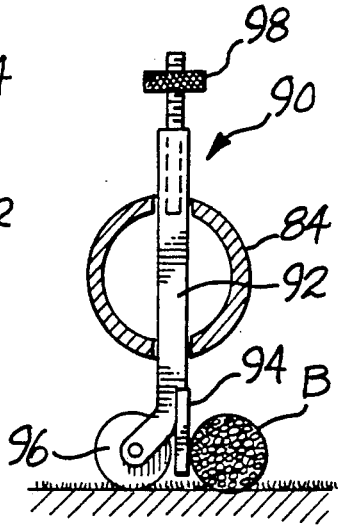
FIG. 12 is an end view of one of the sweeping members of the clearing device, with the rod shown in section.
Figures 8, 9:
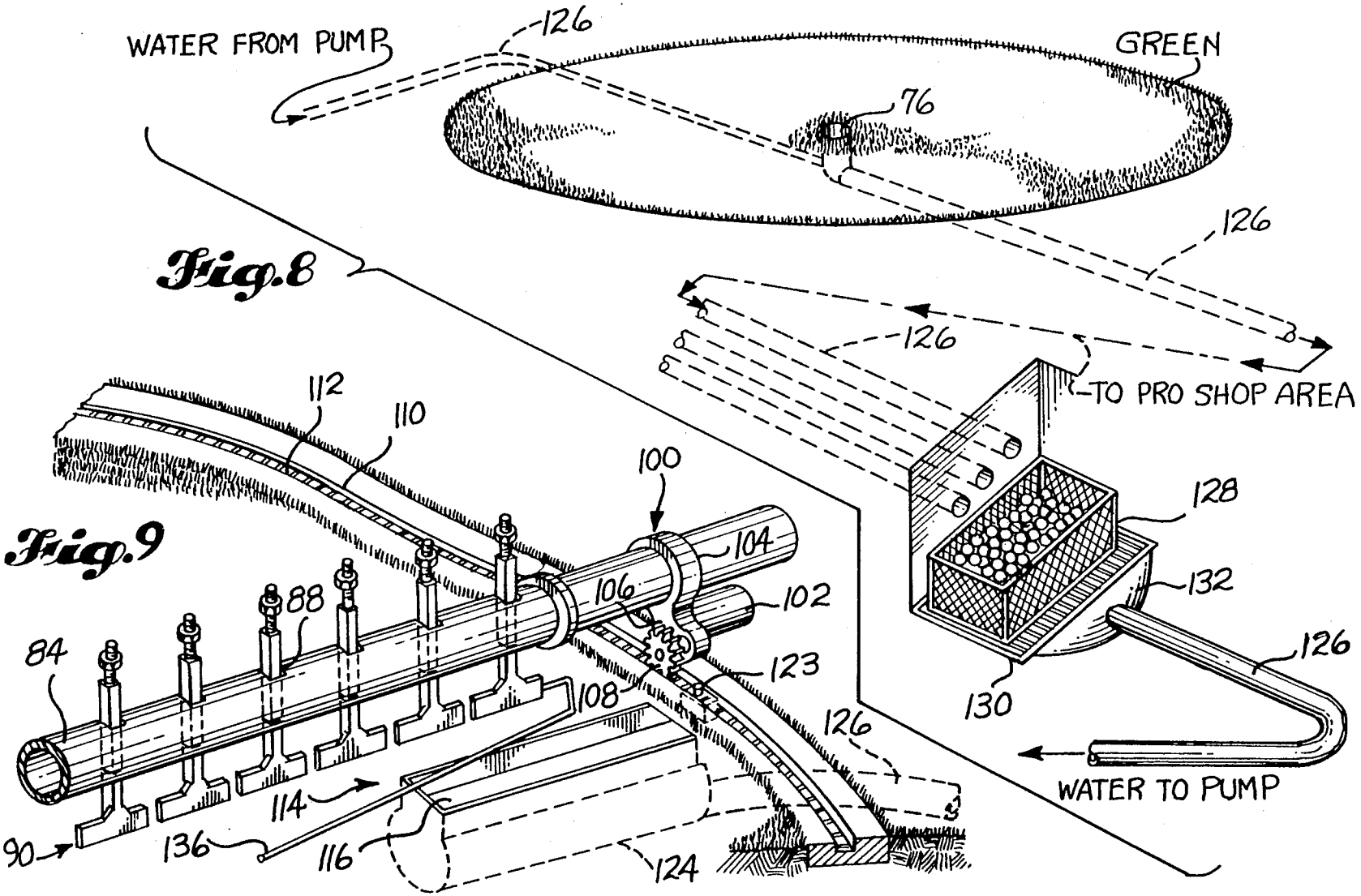
FIG. 8 is a schematic pictorial view of the ball retrieval system associating with the clearing device.
FIG. 9 is a pictorial view of an outer portion of the clearing device.

The flag stick 74 extends upwardly from the hole 76 and defines a vertical axis X. The sweeping mechanism of the green clearing device 72 includes a substantially rigid rod 84 that extends radially outwardly from the hole 76 and the vertical flag stick 74. The rod 84 is mounted on the stick 74 by means of a bearing collar 86 to rotate about the axis X. As shown in FIGS. 6 and 9, the rod 84 has a plurality of holes 88 extending vertically therethrough at spaced locations along the rod 84. Each of these holes 88 receives a leg portion 92 of a sweeping member 90, as shown in FIG. 12. The legs 92 and holes 88 are keyed to prevent rotation of the legs 92 in the holes 88. As shown in the drawings, the legs 92 and the holes 88 have a square configuration. Each leg 92 extends vertically downwardly from its corresponding hole 88. A sweeping blade 94 and a wheel 96 are mounted on the bottom of the leg 92. The wheel 96 is mounted behind the blade 94 so that it does not interfere with the blade's sweeping action. In order to ensure that the blades sweep balls radially inwardly or outwardly, the blades are preferably angled about a vertical axis relative to the rod and/or are laterally offset from the rod (not shown). Each blade is preferably individually adjusted to the contours of the green. At present, the applicant has not yet determined the best manner of implementing this feature.

The leg 92 is free to move vertically relative to the rod 84 so that the sweeping member 90 may follow the terrain of the green. The upper end of the leg 92 is cylindrical and threaded and has an adjustable stop nut 98 thereon to prevent the sweeping member 90 from dropping out of the hole 88. This allows the rod 84 and the sweeping members 90 to be more easily moved as a unit for maintenance. The adjustability of the nut 98 allows adjustment of the degree of vertical movement of the sweeping member 90.

The outer end of the rod 84 is preferably supported and guided on a track 110, as shown in FIG. 9. The outer support for the rod 84 may be at a fixed location along the rod in installations in which the distance from the cup 76 to the periphery of the green is constant. In most situations, this distance will not be constant either because the cup 76 is not at the center of the green or the periphery of the green is noncircular. Therefore, the outer support 100 for the rod 84 is preferably movable along the rod 84, as shown in FIG. 9. The support 100 includes a bearing ring 104 which slides along the outer end of the rod 84. A guide foot 106 extends downwardly from the bearing ring 104. A guide wheel is mounted at the lower end of the foot 106. The wheel preferably takes the form of a pinion gear 108, as shown in FIG. 9. The pinion 108 is rotated by a motor 102 mounted on the support 100 and engages a rack gear 112 in the track 110. The motor 102 may be powered by a battery or a power cord that extends along the rod 84 to the stick 74 and into the ground. In situations in which the periphery is circular and climate conditions make it difficult to keep a track clear, the track may be omitted. In such case, the outer end of the rod 84 could be supported on a wheel.

When the motor 102 is operated, the entire sweeping mechanism rotates about the axis X. As the rod 84 rotates, the sweeping members 90 freely move vertically to follow the contours of the green. The ends of the rod 84 are supported by the bearing collar 86 and bearing ring 104. The wheels 96 on the sweeping members 90 ride lightly on the surface of the green. As the rod 84 rotates, the balls on the green surface are pushed by the blades 94. Depending on the contour of the green and the exact orientations of the blades 94, the balls are either pushed inwardly toward the cup 76 or outwardly toward the periphery of the green. The balls that are pushed inwardly are guided into the cup 76. The balls that are pushed outwardly are guided into an outer ball collector 114.

Figure 10:
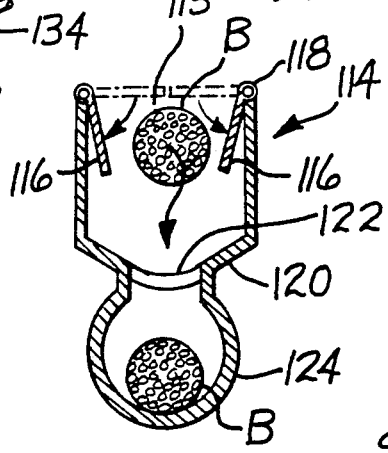
FIG. 10 is a vertical sectional view of the ball collector shown in FIG. 9 in an open position.

The outer ball collector may take various forms. The currently preferred embodiment is shown in FIGS. 9 and 10. The collector 114 comprises an openable slot 115 that extends radially inwardly for a distance of about two feet from the periphery of the green adjacent to the track 110 toward the cup 76. The slot 115 is provided with trap doors 116 mounted on hinges 118 so that it may be closed while iron shots are being made onto the green and thereby will not interfere with such iron shots. Referring to FIG. 10, the slot 115 is provided with a tapered bottom wall 120. The bottom wall 120 may have an opening extending all the way along it, or a series of separate holes, such as the hole 122 illustrated in FIG. 10. When the sweeping mechanism approaches the collector 114, a microswitch 123 located in the track 110 is activated to open the trap doors 116 and allow balls B to drop into the slot 115, as illustrated in FIG. 10. A ball B entering the slot 115 falls under the action of gravity through one of the holes 122 into a conduit 124.

Figure 11:
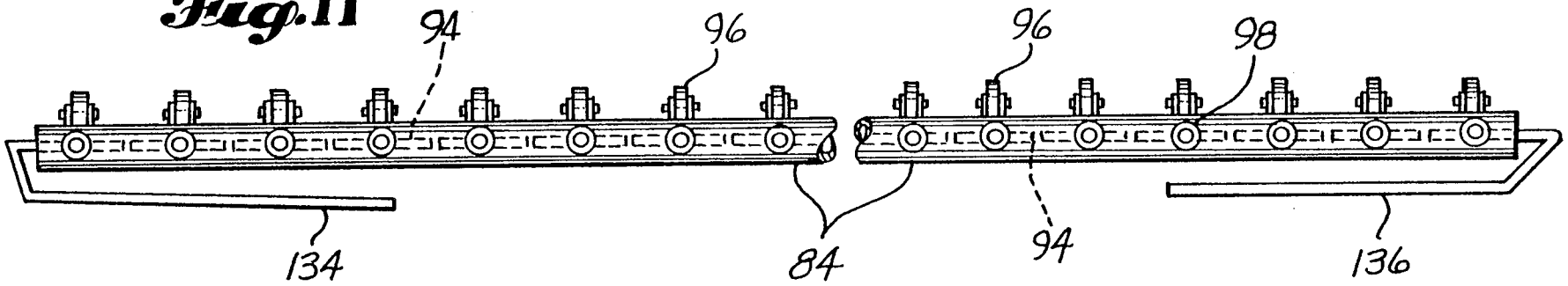
FIG. 11 is a plan view of the rod portion of the clearing device and the structures mounted thereon.

Balls being swept along by the sweeping mechanism may have a tendency to bounce around in the area of the cup 76 or collector 114. To prevent this from happening and to ensure that each ball enters either the cup 76 or collector 114, the clearing device is preferably provided with supplemental guide means. The currently contemplated form of this supplemental guide means is shown in FIGS. 7, 9, and 11. The inner guide means associated with the cup 76 and shown in FIGS. 7 and includes a heavy guide wire 134. The wire 134 extends radially inwardly toward the flag stick 74 about one quarter of an inch from the inner blade 94 which extends over the rim of the cup 76 about three quarters of an inch. The wire 134 then bends at an angle of about 45° and extends a further distance of about two inches The wire 134 then bends again to extend substantially parallel to the rod 84 for a distance of about twelve inches. The wire forms a catcher for balls moving inwardly toward the cup 76. The distance between the longest leg of the wire 134 and the blades 94 of the sweeping mechanism is slightly greater than the diameter of a golf ball. Therefore, the balls are guided between the wire 134 and the blades 94 into the cup 76. The outer end of the rod 84 is provided with an outer guide wire 136 which has substantially the same structure as the inner guide wire 134 and acts to guide the balls into the outer ball collector 114

In order to ensure that the sweeping mechanism does not interfere with shots onto the green, it is aligned behind the flag stick 74 relative to the tee position of the ball B, as shown in FIG. 4. A control box 60 to remotely realign the mechanism, and to activate it after the shots are made, is mounted on the monitor 58.

The portion of the apparatus for retrieving the balls collected in the cup 76 and ball collector 114 is illustrated in FIG. 8. Underground pipes 126 communicate with the cups 76 and ball collectors 114 at the greens via the conduits 82, 124. A pump (not shown) circulates water through the pipes 126 to move the balls to a retrieval location in the pro shop. The balls exit the pipes 126 into a movable basket 128. The basket 128 is mounted on a grate 130 over a catch basin 132. Water from the catch basin 132 is recirculated to the pump. Periodically, the basket 128 is removed and replaced with an empty basket. The cleaned balls from the full basket are ready for use by additional players.

The course of the invention may be used in various ways for practicing golf skills and may accommodate various types of golf-like games. The following is a description of an example of the use of the course of the invention which is the presently preferred manner of use.

A golf-like game may be played by an individual, a twosome, or a foursome on either of the courses 2, 2''' shown in FIGS. 1 and 13. Referring to FIG. 1, the first eight holes of the game involve iron shots of varying lengths between the teeing locations 40–52, , 140 and the greens 18–36. The distances range from about twenty yards to about 180 yards. As discussed above, preferably, shots to a single green 18–36 are made from each of the teeing locations 40–52, 140. The eight teeing locations represent the approach shot requirements encountered on a full size golf course The teeing locations vary from level fairway, to undulating fairway, to longer rough cut areas, to the sand bunker 140. In some cases, the teeing locations are elevated with respect to the green, while in other cases, the green is elevated. The teeing locations may also be angled toward or away from the corresponding greens, and/or laterally relative to the shot trajectories, to add further variety to the playing conditions and the difficulty of the iron shots. The water hazard 138 and sand traps 140 further enhance the variety of the conditions.

The play proceeds having each player making two or four iron shots from each teeing location to the corresponding green. Scoring is determined by the distance of each ball from the hole 76. No putts are made on the center greens 18-36. Scoring of the shots is accomplished by viewing the television monitor 58 at the teeing location, which accurately displays the position of the ball on the green. Each player selects his or her best shot for scoring. The score values may be determined, for example, as follows. If the ball fails to come to rest on the green, there is no score for that hole. Balls that come to rest on the green are scored according to the distance from the hole 76. A distance of greater than 40 feet would be worth five points; an additional point would be awarded for a ball between 30 and 40 feet from the hole 76; an additional two points, for a total of seven points, would, be awarded for a distance of between 20 and 30 feet; a total of eight points would be awarded for a distance of zero to 20 feet; and a hole-in-one would score ten points.

A final hole is played upon the practice green area 142. The players putt to a designated number of holes, such as one, two, or four. Points are subtracted from ten depending on the number of holes to be putted. For one hole, two points are subtracted per putt. For two holes, one point is subtracted per putt, but each hole is worth only five points. For four holes, one point is subtracted for each putt greater than a total of six putts.

A similar game may be played on the course 2' shown in FIG. 2. In this case, the scoring on the final hole may be the same as in the case of the course 2 shown in FIG. 1. For the first eight holes, the balls are placed on the peripheral greens 18A-36A in the positions in which they landed on the center greens 18'-36', as described above. When the iron shot did not hit the center green, the player must first chip onto the peripheral green from a designated area. Each player begins with ten points and subtracts five if not on the green after the original shots. Two points are subtracted for the first putt taken and one point for each subsequent putt taken to "hole out".

In the case of the course 2'' shown in FIG. 3, the iron and chip shots and the putts may be scored in the same manner as in relation to the course 2' shown in FIG. 2.

Regular players on the course may participate in a handicap system. After ten recorded rounds, a player's scores are averaged The average is used to determine the player's handicap relative to other players.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. A course for playing a golf-like game and practicing iron shots, comprising:

a central green area including a plurality of separate greens;

a peripheral area around said central green area;

a plurality of separate, spaced apart teeing locations in said peripheral area; each said teeing location being positioned to provide iron shots with predetermined trajectories onto at least one of said greens corresponding to the teeing location; and screening in said central green area and said peripheral area;

said central green area and said peripheral area having varying terrain, and said teeing locations being positioned, to provide iron shots of varying length and difficulty onto said greens; and said greens and said teeing locations being arranged to provide space between said teeing locations and separate players at any one of said teeing locations from players at the other teeing locations, and said screening being spaced from said teeing locations in said peripheral area, being positioned between said greens in said central green area, and extending substantially parallel to trajectories which are adjacent to inhibit shots from any one of said teeing locations crossing said trajectories corresponding to another of said teeing locations, to minimize disturbance of players at any of said teeing locations by players at the other teeing locations, and to simulate playing conditions on a full size course.

2. The course of claim 1, in which each said green has a hole for receiving golf balls hit onto the green; and which further comprises a plurality of television cameras, each said camera being positioned to receive an image of a different one of said greens; a plurality of television monitors at said teeing locations connected to said cameras for receiving said images therefrom; and a grid superimposed over each said image by said monitors and configured to accurately display the distance form said hole of a golf ball hit onto the corresponding green and thereby enable scoring of an iron shot onto said corresponding green.

3. The course of claim 2, further comprising, in each said green, a flag stick extending upwardly from said hole and defining a vertical axis; and a green clearing device including a rod extending radially outwardly from said hole and mounted on said flag stick to rotate about said axis, and a plurality of sweeping members carried by said rod.

4. The course of claim 3, comprising an activator carried by a corresponding one of said monitors for activating said green clearing device.

5. The course of claim 2, in which said greens and said teeing locations are arranged to provide a choice of iron shots to different greens from at least one of said teeing locations.

6. The course of claim 2, which further comprises a plurality of putting practice greens spaced around said central green area in said peripheral area, each said practice green corresponding to a different one of said greens in said central green area; and a plurality of television cameras connected to said monitors and positioned to receive tranmsit images of said practice greens corresponding to said images of said greens in said central green area; said grid being superimposable over aligned images of each said green in said central green area and the practice green corresponding thereto, to permit placement of a ball on the practice green in a position precisely corresponding to a position of a ball on the corresponding green in said central green area without entry upon said central green area.

7. The course of claim 6, which further comprises, in each said green in said central green area, a flag stick extending upwardly from said holes and defining a vertical axis; and a green clearing device including a rod extending radially outwardly from said hole and mounted on said flag stick to rotate about said axis, and a plurality of sweeping members carried by said rod.

8. The course of claim 7, comprising an activator carried by a corresponding one of said monitors for activating said green clearing device.

9. The course of claim 1, in which each said green has a hole for receiving golf balls hit onto the green; and which further comprises, in each said green, a flag stick extending upwardly from said hole and defining a vertical axis; and a green clearing device including a rod extending radially outwardly from said hole and mounted on said flag stick to rotate about said axis, and a plurality of sweeping members carried by said rod.

10. The course of claim 1, further comprising hazards associated with said greens.

11. The course of claim 1, in which said greens and said teeing locations are arranged to provide a choice of iron shots to different greens form at least one of said teeing locations.

12. The course of claim 1, further comprising a practice green area separate from said central green area and having a plurality of holes for putting practice.

13. The course of claim 1, further comprising a plurality of putting practice greens spaced around said central green area in said peripheral area, each said practice green corresponding to a different one of said greens in said central green area.

14. The course of claim 13, in which each said green in said central green area has a hole for receiving golf balls hit onto the green; and which further comprises, in each said green in said central green area, a flag stick extending upwardly from said hole and defining a vertical axis; and a green clearing device including a rod extending radially outwardly from said hole and mounted on said flag stick to rotate about said axis, and a plurality of sweeping members carried by said rod.

15. A course for playing a golf-like game and practicing iron shots, comprising:

a central green area including a plurality of separate greens, each said green having a hole for receiving golf balls hit onto the green;

in each said green, a flag stick extending upwardly from said hole and defining a vertical axis; and a green clearing device including a rod extending radially outwardly from said hole and mounted on said flag stick to rotate about said axis, and a plurality of sweeping members carried by said rod; said sweeping members being mounted onto said rod at spaced locations along said rod, and each said member being free to move vertically relative to said rod to follow the terrain of the green;

a peripheral area around said central green area; and a plurality of spaced teeing locations in said peripheral area;

said central green area and said peripheral area having varying terrain, and said teeing locations being positioned, to provide iron shots of varying length and difficulty onto said greens.

16. Apparatus for clearing a green of golf balls, comprising a rigid flag stick defining a vertical axis; a rod mountable on said flag stick to extend radially outwardly from said stick to a peripheral area of the green, and to rotate about said axis; a plurality of sweeping members carried by said rod, said members being mounted at spaced locations along said rod, and each said member being free to move vertically relative to said rod to follow the terrain of the green; and a support engaging an outer end portion of said rod to guide and support said outer end portion around said peripheral area.

17. The apparatus of claim 16, which further comprises a guide track around said peripheral area; and in which said support has a lower end portion that engages said track, and said support is slidable along said rod to automatically adjust to varying distance between said track and said stick.

18. A method of playing a golf-like game on a course having a plurality of target greens, each with a flag stick, a plurality of practice greens corresponding to said target greens, and a plurality of spaced teeing locations corresponding to said target greens, said method comprising:

placing at least one golf ball on one of said teeing locations, and hitting said ball from said one location onto a corresponding one of said target greens;

determining a score by the distance of said ball from said flag stick of said corresponding green;

without entering onto said corresponding target green, moving to a second teeing location and repeating the steps of placing and hitting a golf ball and determining a score;

transmitting an image of each of said target greens corresponding to said one location and said second location from a television camera to a television monitor at the teeing location corresponding to said target green; and in said monitor, superimposing a grid over said image to display said distances; and simultaneously transmitting said image of said target green and an image of the practice green corresponding to said target green to a television monitor at said corresponding practice green; aligning said images of said target green and its corresponding practice green; using said aligned images as a guide, placing a golf ball on said practice green in a position precisely corresponding to the position of said ball hit onto said target green; and putting said ball on said practice green.

* * * * *

UNITED STATES PATENT AND TRADEMARK OFFICE

CERTIFICATE OF CORRECTION

PATENT NO. : 5,184,824

DATED : February 9, 1993

INVENTOR(S) : Thomas R. Riedinger

It is certified that error appears in the above-indentified patent and that said Letters Patent is hereby corrected as shown below:

Column 1, line 30, there is a period after "shots"; in line 38, after "location"; and in line 66, after "course".

Column 2, line 7, there is a comma after "case"; and line 12, a period after "configuration".

Column 4, line 43, there is a period after "locations"; and in line 48, delete the comma after "shots".

Column 5, line 5, there is a period after "space"; in lines 8, 13, and 14, delete the comma after "40-52"; and in line 66, "18′-36." should be -- 18′-36′ --.

Column 6, line 7, "16," should be -- 16′ --; and in line 14, "When" should be -- when --.

Column 7, line 8, there is a period after "thereto"; and in line 16, "143′′′′" should be -- 143′′′ --.

Column 7, line 32, there is a period after "made"; in line 49, after "feature"; and in line 51, after "greens 20".

Column 10, line 17, after "and", insert -- 11 --.

Column 10, line 22, there is a period after "inches"; in line 34, after "collector 114"; and in line 64, delete the second comma after "40-52".

Column 11, line 2, there is a period after "course"; and in line 60, after "averaged".

UNITED STATES PATENT AND TRADEMARK OFFICE

CERTIFICATE OF CORRECTION

PATENT NO. : 5,184,824

DATED : February 9, 1993

INVENTOR(S) : Thomas R. Riedinger

It is certified that error appears in the above-indentified patent and that said Letters Patent is hereby corrected as shown below:

Claim 1, column 12, line 25, there is a comma after "adjacent".

Claim 2, column 12, line 40, "form" should be -- from --.

Claim 6, column 12, line 63, delete "receive"; and change "tranmsit" to -- transmit --.

Claim 11, column 13, line 27, "form" should be -- from --.

Signed and Sealed this

Twenty-second Day of March, 1994

*Attest:*

Bruce Lehman

BRUCE LEHMAN

*Attesting Officer*

*Commissioner of Patents and Trademarks*